United States Patent [19]

Zucker

[11] Patent Number: 4,474,297

[45] Date of Patent: Oct. 2, 1984

[54] STORAGE AND DISPENSER RACK

[75] Inventor: Armand S. Zucker, Skokie, Ill.

[73] Assignee: RTC Industries, Inc., Chicago, Ill.

[21] Appl. No.: 454,997

[22] Filed: Jan. 3, 1983

[51] Int. Cl.[3] ..... A47F 1/00

[52] U.S. Cl. ..... 211/49 D; 211/184; 312/45

[58] Field of Search ..... 211/49 D, 74, 189, 183, 211/184; 193/2 D, 2 A; 312/42, 45, 72

[56] References Cited

U.S. PATENT DOCUMENTS

| | | | |
|---|---|---|---|
| 2,443,871 | 6/1948 | Shield | 211/49 D |
| 3,784,022 | 1/1974 | Beesley | 312/45 X |
| 4,105,126 | 8/1978 | Deffner et al. | 211/49 D |
| 4,162,013 | 7/1979 | Tucker | 211/184 X |
| 4,228,903 | 10/1980 | Eckert | 211/49 D |
| 4,356,923 | 11/1982 | Young et al. | 312/45 X |
| 4,372,451 | 2/1983 | Rasmussen et al. | 211/184 X |

*Primary Examiner*—William H. Schultz
*Assistant Examiner*—Robert W. Gibson, Jr.
*Attorney, Agent, or Firm*—Norman Lettvin

[57] ABSTRACT

A new storage and dispenser rack is provided for quasi-cylindrical containers such as bottles, wherein the ends of the containers are of different dimension but with a belly portion of the container being substantially of the same size and shape as the large end of the container. The rack is made of molded plastic parts that are constructed and designed to snap together. The rack includes a pair of upright panels that define a bay and provide thereon tiers of tracks, each for supporting one end of the quasi-cylindrical containers. A plurality of transverse spacer shafts that connect with the pair of panels operate to provide a free-standing structural grid for the rack. The spacer shafts are of an axial length selected for the size of the containers to be supported on the rack. An add-on track member is provided for support of quasi-cylindrical containers, with means provided on the underside of the track member arranged for snap-on connection with male snap-on members provided in female sockets provided on, and located intermediate the ends of, the transverse spacer shafts.

7 Claims, 7 Drawing Figures

FIG. 1
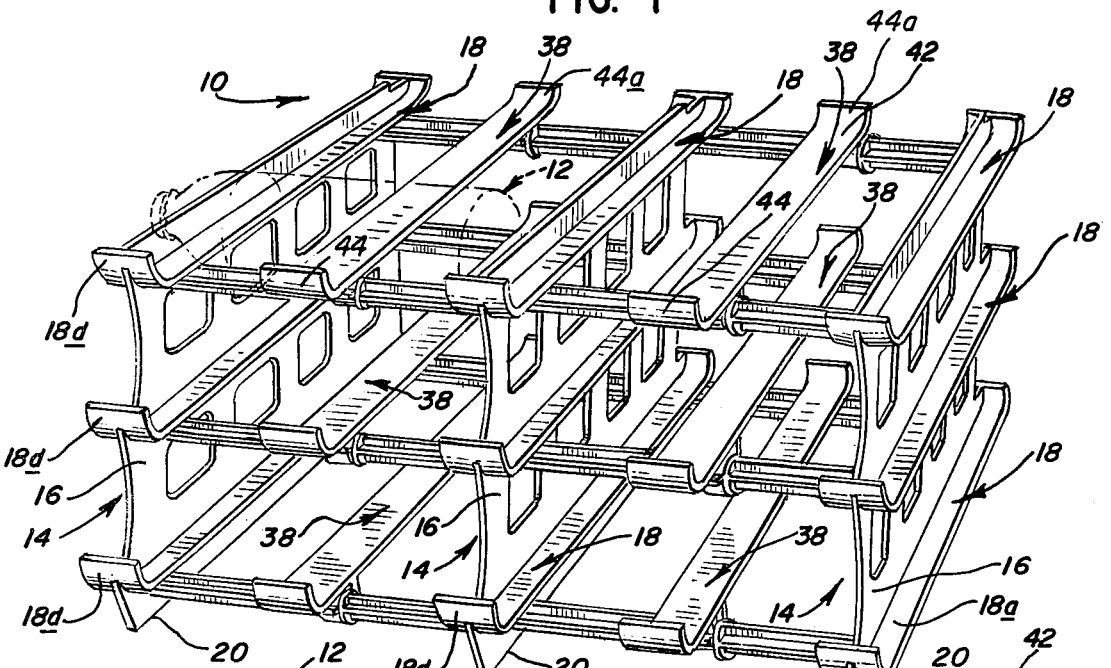
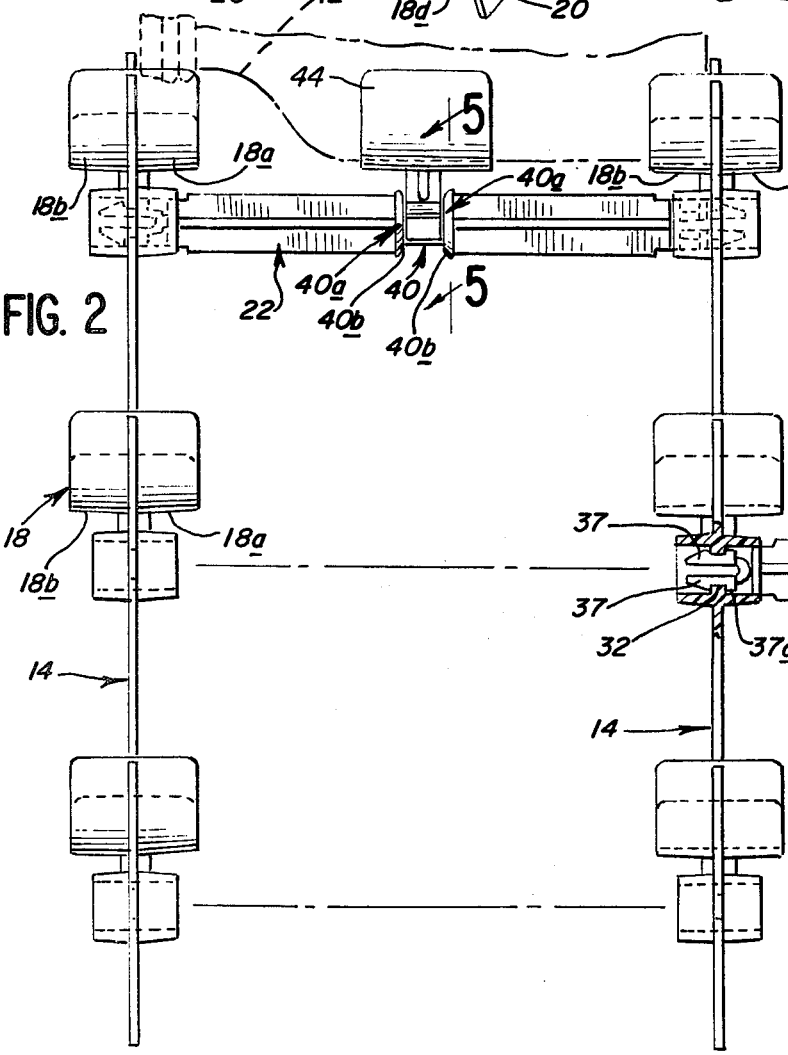
FIG. 2
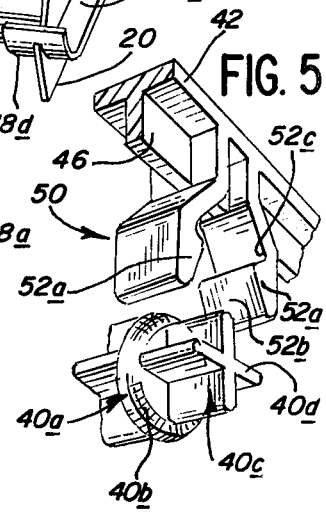
FIG. 5
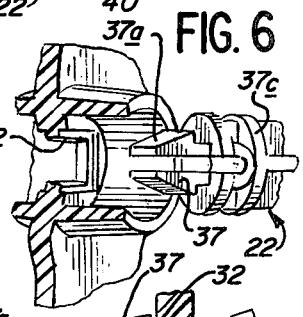
FIG. 6
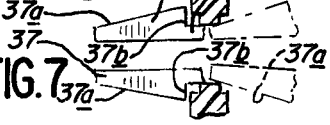
FIG. 7

STORAGE AND DISPENSER RACK

FIELD OF THE INVENTION

This invention relates to a storage and dispenser rack for use in food stores and the like, and more particularly relates to an improved storage and dispenser rack for use with bottled goods and the like.

BACKGROUND OF THE INVENTION

It is known to provide, for use in food stores and the like, a rack for storing and dispensing filled cylindrical containers, wherein the rack is formed of inexpensive molded plastic parts that are snapped together to provide a structural grid.

Heretofore, such snap-together racks have been useful only with cylindrical containers whose opposite ends are of the same size. Many quasi-cylindrical containers, such as bottles, have at one end thereof a neck and mouth of reduced size relative to the base of the container, although an intermediate, or belly, portion of the container, is frequently of the same size as the container's base. The prior racks cannot accommodate such quasi-cylindrical containers.

BRIEF SUMMARY OF THE INVENTION

It is an object of this invention to provide a new and improved rack for storing and dispensing quasi-cylindrical containers such as bottles.

Another object of this invention is to provide an improved rack construction, for use with quasi-cylindrical containers, and wherein the improved rack uses the same upright molded panels of the prior art rack, but which new construction employs a simple and inexpensive add-on track which provide support and guidance for the quasi-cylindrical containers stored on the rack.

A further object of this invention is to provide a rack construction that is characterized by inexpensiveness and attractiveness of construction and by versatility of usage.

Further objects and advantages of this invention will become apparent to one skilled in the art from the following description of the invention.

DESCRIPTION OF THE DRAWINGS

FIG. 1 is a perspective view of the improved rack of this invention, illustrating in phantom how a bottle is accomodated and supported on the upper tier in the left hand bay of the rack;

FIG. 2 is an enlarged, fragmentary, front elevational view of the free-standing, grid-like rack of FIG. 1, and showing an add-on track and its connection to a transverse spacer shaft at the uppermost, or third, tier in the left hand bay of a two-bay rack;

FIG. 5 is an enlarged, fragmentary, perspective view showing the interconnecting structures that are provided on an add-on track member, as seen in FIG. 4, and on a transverse spacer shaft of the rack, prior to their interconnection, the view of said interconnecting parts being taken substantially at a location shown by line 5—5 of FIG. 2, but showing the parts separated and in perspective;

FIG. 6 is an enlarged, exploded, fragmentary, perspective view of one end of a spacer shaft and its complementary socket means on an upright panel, the parts being shown in different attitudinal aspects for purposes of illustrating the details of the parts; and FIG. 7 is an enlarged fragmentary view illustrating how the cooperating portions of the end of a spacer shaft, and its complementary socket on an upright panel, cooperate to provide a press-into and snap-together joint between those two parts.

DETAILED DESCRIPTION OF THE DRAWINGS

Figures 3, 4:
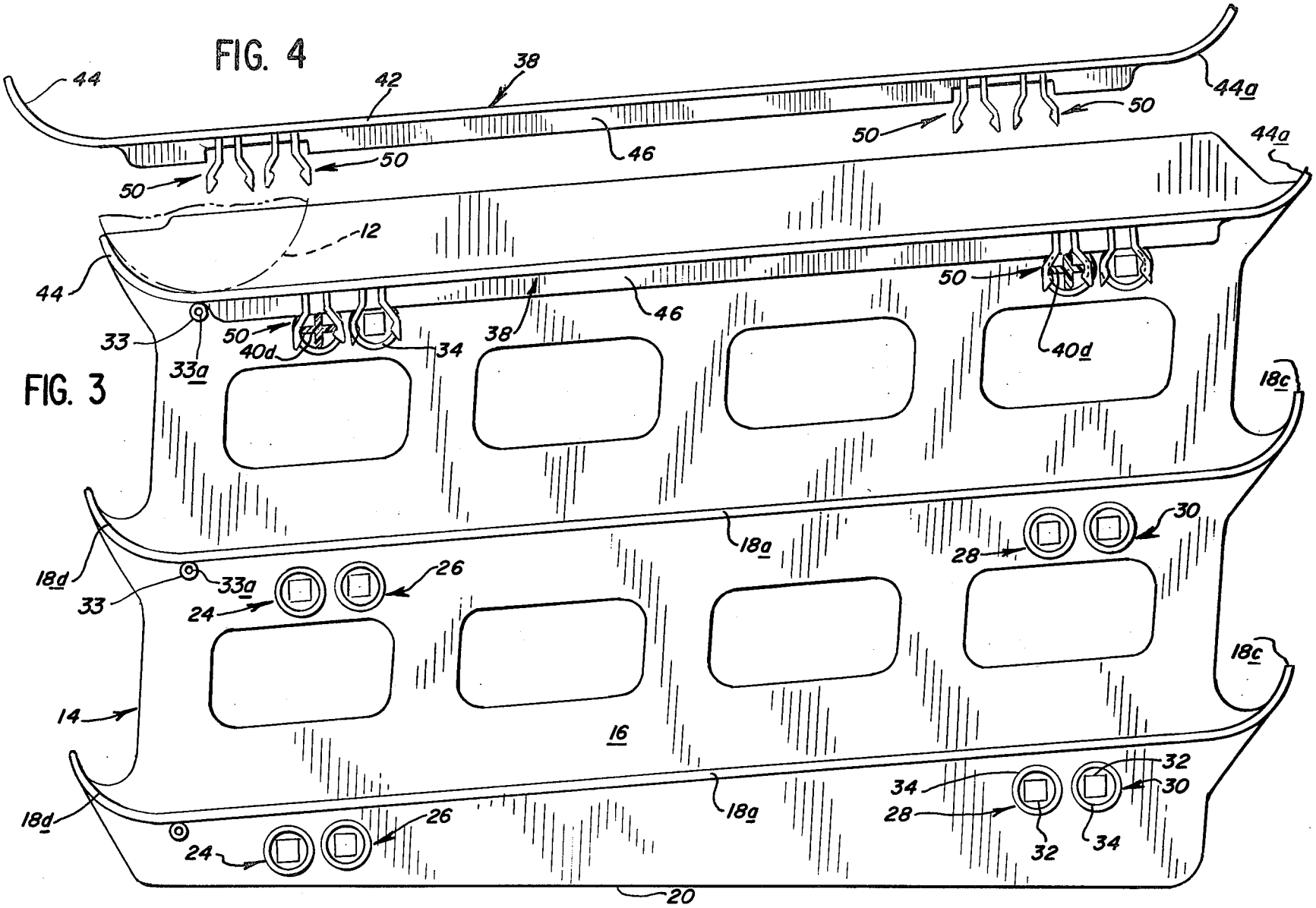
FIG. 3 is a longitudinal, sectional view, through a bay of the rack of FIGS. 1 and 2, showing an add-on track assembled onto a pair of transverse spacer shafts of the rack.
FIG. 4 is a fragmentary side elevational view of another, but preferred, form of the add-on track member showing additional features over the form of add-on track shown in FIG. 3.

Referring now to the drawings, FIG. 1 shows a rack, generally 10, for storing and advancing containers such as bottles. One such bottle is shown in FIG. 1 at 12 in broken lines, and is also seen in fragment in FIGS. 2 and 3.

The rack 10 is a structural grid made up of molded plastic parts, namely a plurality of upright, molded, elongated panels and elongated transverse spacer shafts which are snap-connected at their ends transversely to and between a pair of molded panels. Such a grid construction is generally known in the prior art, although certain important features set forth herein have not heretofore been employed in the prior art.

FIG. 3 shows, in front elevation, the molded upright panel 14. The panel 14, also seen in edge elevation in FIG. 2, is molded to provide an upright central web 16 with three elongated track flanges 18, each of which runs the length of panel 14, and are vertically spaced to provide two elongated channels for receiving containers thereinto, each channel being located between adjacent pairs of track flanges 18, and an uppermost track means, for receiving containers thereonto. The track flanges 18 project laterally outwardly of both sides of web 16 to provide, when panel 14 is viewed head on, as seen in FIG. 2, tracks **18*a* to the right of a web 16, and tracks 18*b* to the left of a web 16**.

Each track flange 18 cooperates with central web 16 to provide on opposite sides of web 16 two support tracks, **18*a* and 18*b*, each of which is adapted to have rested thereon an edge of a cylindrical container, such as a cylindrical can of food, while portions of the web 16 immediately above the upper surface of track 18** serve as a guide for the adjacent transverse end of the container when the circular edge of the cylinder is supported on one of the support tracks.

Each track flange 18 is inclined forwardly and downwardly from the track's raised rear end to a lowermost point adjacent an upwardly and forwardly curved toe end, or container stop, **18*d*. The rear end stop flange 18*c* extending upwardly of the track surface, is also curved upwardly, in mirror image of container stop 18*d*, as seen in FIGS. 1 and 3**.

In one typical rack structure shown in FIGS. 1–3, each upright panel 14 has three vertically spaced track flanges 18 which provide three tiers adapted for storage of containers thereon. As shown in FIGS. 1 and 2, the rack structure defines two identical side-by-side, lateral bays for receiving containers thereinto, located upon each of the tiers of the bay. As will be understood from the description hereinafter, the number of bays may be only one, or may be multiplied merely by attaching additional panels 14 interconnected by transverse spacer shafts.

The panel 14 has its lowermost track flange 18 spaced above the horizontal lower edge 20 of the panel, which is adapted to be rested on a support surface, not shown, which could be a floor or a horizontal shelf. Below each track flange 18, and provided integral with web 16, are two longitudinally spaced sets of sockets, generally indicated at 22 in FIGS. 2 and 6, with each socket adapted to receive and connect with an end of a transverse spacer shaft. One set of two sockets 24 and 26, is the forward set located closer to the forward end of track flange 18, and the other, or rearward, set of two sockets 28 and 30 is located closer to the rear end of track flange 18.

As best seen in FIG. 3, each socket 24, 26, 28 and 30 includes a shaped central opening 32, that extends through web 16, and with a transversely extending, annular sleeve 34 spaced from and surrounding opening 32 and projecting in opposite directions from web 16. The shape of opening 32 is shown to be square, but other shapes could be used, depending upon the shape of the connecting end of the transverse spacer shaft. The inner periphery of sleeve 34 is shown as round, but again another shape could be used depending upon the shape of the cooperating and telescoping end of the spacer shaft.

The combination of upright panels 14, interconnected by transverse spacer shafts 22 provides a free-standing structural grid in the form of rack 10, as shown in FIG. 1, that is two bays wide and three tiers high. It is contemplated that a rack that would use the features of this invention would be at least one bay wide and at least two tiers high. Multiple bays and tiers may be used as necessary or as desired.

Each of the sockets 24, 26, 28 and 30 is spaced equally from and below the support surface on an adjacent track flange 18. Each central opening 32 of a socket may be entered from the left or right of the panel 14, as seen in FIG. 2, but only one spacer shaft enters the single central opening 32 of a socket to cooperate therewith. For that reason, two adjacent pairs of openings 32 are provided as a set, permitting entry of one opening 32 from the left side of panel 14, and then the adjacent other opening 32 of the pair is entered from the right, or opposite, side of panel 14.

It will be understood that with cans, or other cylindrical containers, stored on the tracks 18, there will be one such article engaging the front stop **18*d*, and other similar articles will be backed up behind said front article, supported on the track and abutting against a forward article, with the opposite ends of each cylindrical container supported on oppositely laterally facing tracks 18*a* and 18*b* respectively on two adjacent panels 14**. If any article, at a forward selection station on a track, is removed by a shopper from the rack, all remaining container articles spaced behind the one that is removed will automatically advance, or roll, or slide, forwardly under force of gravity, along the tracks. An attendant may fill each tier of each rack from the back side of the rack, thereby keeping the racks constantly supplied with articles to be selected by passing customers.

Each upright panel 14 is also provided immediately below each track 18, and immediately rearwardly of the integral front stop **18*d*, and to each side of web 16 with an integrally molded sign-support boss 33 having a central bore 33*a*. A pair of opposed bosses 33, each with a bore 33*a* therein, located on a pair of panels 14** provides for, and permits mounting therein of pin extensions provided adjacent the upper edge of a molded advertising sign or flag, not shown, whose usage is known in the rack art.

What has been described thus far is known in the prior art. What is new and disclosed in this application will now be described.

To provide that the prior art rack may be modified to accommodate bottles, or containers, whose ends are frequently of different size and shape, and which are also referred to herein as quasi-cylindrical containers, the grid structure described above is modified in two respects, first, by providing a modified form of transverse spacer shaft, and second by providing an add-on track that cooperates with the modified spacer shaft and to thereby support the bottle, or other container, at an intermediate section, or belly, of the container.

In the figures of the drawing, the specific modified spacer shaft used is designated 36. The spacer shaft 36 and all features thereon, as hereinafter disclosed, are integrally molded. The add-on track member is generally designated 38 and is shown separated from the spacer shaft in side elevation in FIG. 4, and in a fragmentary view in FIG. 5.

Assuming that the containers to be stored on the rack 10 all correspond with bottle 12, as illustrated, then each of the containers stored on rack 10 will have a selected length between its base end 36 and its capped end 38. Many bottles usually have at least a central, belly, portion that is of a cylindrical periphery and size corresponding substantially with the periphery and size of the bottle's base end. The effective length of spacers shaft 36 is selected to be commensurate with the length size of the bottles to be stored upon rack 10, such that when a pair of panels 14 are interconnected by spacer shafts 36, as seen in FIGS. 1 and 2, the webs 16 of the panels 14 will lie closely adjacent, but spaced slightly from, said bottle ends 36 and 38 to serve as guides for articles 12 stored on the rack. As seen in FIG. 2, the flange track **18*b*, at the right of the rack bay shown, is adapted to have the bottle's base end 36** positioned thereon to roll, or slide, therealong.

The effective spacing length of spacer shaft 36 corresponds with the distance between the oppositely facing sides of webs 16 that surround the openings 32 that extend through webs 16.

Since bottles are of many different length dimensions between base end 36 and cap end 38, it may be necessary, for the racking of a particular product, to provide transverse spacer shafts of a particular length for use in a particular rack 10.

As shown in the detail drawings, provided as FIGS. 6 and 7, each end of spacer shaft 36 that snap-connects with a panel 14 includes a pair of oppositely arranged, cantilevered, spaced, camming prongs 37, whose cantilevered mountings provide that when the inclined, camming surfaces **37*a* of the prongs are thrust against one pair of the two sets of opposite edges of square opening 32, the prongs 37 are forced together, as shown in broken lines in FIG. 7, as the prongs enter into opening 32, and the spacing of the prongs 37 is such as to permit them to pass through opening 37 until the abutments, or retaining shoulders, 37*b* have passed through opening 32, and the prongs 37 then snap back to the condition shown in full lines in FIGS. 2 and 7, thereby operating to securely hold spacer shaft 36 against separating from panel 14. By the foregoing construction, the ends of spacer shaft 36 have a press into and snap-together fit with complementary socket means that are molded integral with the upright panel 14. The tips of prongs 37 protruding through opening 32 may be pressed together to permit selective removal from the snap-connection arrangement described. The shape of the section 37***c* on spacer shaft 36 is cylindrical and is of a size to slidingly telescope into cylindrical sleeve 34 in a close fit, to provide a support that holds spacer shaft 36 perpendicular to the plane of web 16 of panel 14.

The remainder of transverse spacer shaft 36, located between spaced cylindrical sections 37*c*, is of a cross-shape, as can be seen in FIGS. 1 and 2, except for a centrally located, transverse, female socket, portion 40 that is provided therein with snap-connector means that are shaped and adapted to cooperate with a snap-connector means provided on the add-on track 38.

The central, female socket connector, portion means 40 is so located axially of spacer shaft 36 that when the add-on track member 38 is connected to a spaced pair of spaced transverse shafts 36, such as shown in FIG. 3, the upper support surface of the add-on track 38 is positioned to engage and support the belly of bottle 12, as seen in FIG. 2. The female socket portion 40 of shaft 36 is integral with shaft 36 and is located vertically below the add-on track member 38, and is bounded by a pair of spaced, oppositely facing, upright flanges, or discs, 40*a* that each provide thereon an annular, frustro-conical, camming surface 40*b*. Between the pair of spaced flanges, or discs, 40*a*, there is provided an axially elongated, snap-onto, male connector means, or stud member, 40*c* that extends axially of shaft 36 and has a cross-sectional form to provide two crossed, axially extending ribs, with one rib 40*d* of the cross lying in a plane that is substantially parallel to the track incline along which the bottles 12 are caused to roll or slide.

The foregoing arrangement provides that the pair of outermost edges of rib 40*d* are at an attitude to be effectively engaged and gripped by female snap-connector means provided on the add-on track member 38.

The add-on track member 38 is a molded, integral part that provides an elongated, flat, upper support track strip 42, that provides thereby a flat, unobstructed, upper surface of substantially the same operative length and longitudinal support shape as provided by the associated track 18*a* or 18*b* on a panel 14, and with an upturned stop 44 at the forwardmost end of track strip 42, that is, when assembled on a rack 10, of substantially the same shape, and positional relationship, as stops 18*d*. The underside of support track strip 42 is reinforced along the greater portion of its length with an integral, transversely arranged, reinforcing spine, or rib, 46 spaced centrally between the lateral edges of track member 38.

In the preferred form, the add-on track member 38' of FIG. 4 is constructed so that the left and right (front and rear) halves, as seen in side elevation in FIG. 4, are identical but of mirror image, relative to the center point, or mid-length point, of track member 38'. Thus, where the front end is provided with an upturned stop 44 that is of an arcuate shape, as shown, cupped to face right to conform with of a quasi-cylindrical body shape, the rear upturned stop 44*a* is similarly shaped and cupped to face left. This arrangement also permits front loading of the rack without fear of a product being pushed off the rear of the track. This lengthwise symmetry of the add-on track member 38' is desirable, as the track 38' does not have to be oriented for proper lateral alignment with the other tracks of the rack.

When the track member 38' of FIG. 4 is employed, the upright panels of the rack should be of slightly modified construction so that the rear end stops on track flanges 18 will have a shape and location corresponding with the rear upturned stops 44*a* on the add-on track members 38'. The length of the track flanges 18 on the modified upright panels should also correspond to the track length of the add-on track members 38'.

The underside of add-on track member 38 is also provided with four sets of snap-on means 50, constructed and arranged for a snap-together cooperation with a plurality of transverse spacer shafts 36 each provided with a female socket portion 40 and a male snap-connector stud 40*c* therein. As shown, four snap-on means 50 are provided on track member 38, arranged so that there are two forward sets and two rearward sets of snap-on means 50, the spacing of which is selected to conform with the spacing of the female socket portions 40 provided on the spacer shafts 36.

Each snap-on means 50 consists of two identical, downwardly extending, elongated, shaped prongs 52 arranged to face in opposite directions, and to cooperate to provide a female snap-connector means, as clearly seen in FIGS. 3–5. One end of each prong 52 is molded integral with the underside of the support track strip 42 and the reinforcing rib 46, to provide rigidity at the mounting end of prong 52. The unsupported end of the prong 52, which is of a transverse size, shape and dimension to enter the female socket means 40 on the spacer shaft 36, provides a jaw 52*a* that is the mirror image of an oppositely facing jaw 52*a*, and which is shaped to provide a distal cam edge 52*b* at the extended end of prong 52 which lies adjacent the crook 52*c* of the elbow of the prong 52. The oppositely facing crooks 52*c* of the elbows of each pair of prongs 52 provide a dwell location that receives thereinto the lateral edges of rib 40*d* of the male snap-connector member 40*c*. The cam edges 52*b* provide distal cam means for camming, through a press action, the prong jaws 52 past the edges of rib 40*d*, to provide a snap-onto connection with the male snap-connector member 40*c*. The transverse width of the parallel edged portion of prongs 52 that enter into female socket portion 40 is selected to fit closely to, and adjacent, the closest spacing between flanges 40*a*, and the frustro-conical camming surfaces 40*b* on flanges 40*a* operate to guide the parts together as they are moved into the snap-connecting, securing relationship with each other.

Since only two transverse spacer shafts 36 are to be provided in association with each set of tracks in a tier of a bay of the rack, the provision of four snap-on means 50 on each add-on track member 38, and locating such means 50 at longitudinal spacings corresponding with the longitudinal spacings of the openings 32 below track flanges 18, insures that each add-on track 38, when properly assembled onto a structural grid as described, will be provided with at least two longitudinally spaced spacer shafts 36 with which to connect.

The rib 46 is of a selected vertical extent to reinforce the track strip 42, except in the region where the sets of snap-on prongs 52 are located, where the height of rib is reduced, as shown, to only one-half its height, so as to reduce the stiffening imparted to the intersected mounting ends of the cantilevered prongs 52.

The width of the elongated support track strip 42 of the add-on track 38 preferably is at least twice the width of an associated track 18*a* or 18*b* on the upright panel 14, to provide adequate support for the intermediate, or belly, section of bottle 12.

It will be seen from the foregoing that there has been provided an improved, free-standing, structural grid, for a storage and dispensing rack that has improved features, including flexibility to store and accomodate thereon, as desired, either or both cylindrical or quasi-cylindrical containers, and permitting either rear or front loading of the rack. The components of the structural grid permit flexibility in selection of spacing of the rack's panels, so that bottles maybe accommodated in one bay of a rack, while cans of different height than the bottles, may be accommodated in an adjacent bay of the rack.

While there has been disclosed a number of forms of my invention, it will be understood by one skilled in the art that other variations may be made and included in the concepts disclosed, and I intend that my invention, as defined by the claims herein, cover all such modifications and additions.

I claim:

1. In a storage and dispenser rack for use in food stores and the like, for storing generally elongated, filled, cylindrical containers, and for advancing said containers by rolling or sliding to a forward selection station where a consumer is free to select a forward container, whereupon the remaining containers located behind the selected container then automatically advance, by force of gravity, toward said selection station, said rack being formed by a plurality of molded upright panels, with adjacent spaced pairs of panels being interconnected by a plurality of elongated, spacer shafts whose respective ends are each constructed for axial, press-into and snap-together, fit with a complementary socket means molded integral with an upright panel, to provide a free-standing, structural grid, that provides at least one bay bounded by a pair of spaced upright panels, and at least one tier of longitudinal track pairs in each bay of the structural grid, wherein said tracks each incline downwardly from a raised track rear to a lowermost point adjacent a raised container stop that extends across the front of the track, with each track adapted to have an end edge of a container supported thereon and guided by an upright associate flange that is part of an upright panel and extends along the length of the track, with the spacing of said upright associate flanges, being slightly greater than the axial length of the container;

the improvement of means for converting a bay of said free-standing structural grid to one upon which may be stored, and advanced, quasi-cylindrical containers such as capped bottles, where at least a central, belly, portion of each of the containers conforms with the shape and size of the cylindrical base of the container, and comprising in combination:

the spacer shafts having an effective length between a pair of upright panels, that is commensurate with the size of bottles to be stored in said bay of the rack so that at least one of said upright associate flanges on the pair of upright panels which bound the bay will function to provide guidance for one end of the bottles;

each spacer shaft having formed thereon, between the ends thereof, a transverse female-socket connector means that is bounded by a pair of spaced, oppositely facing, upright flanges provided integral with the spacer shaft, said female-socket connector means having located therein an elongated snap-onto male connector means that extends axially of the spacer shaft between said flanges of the female-socket connector means;

and an elongated, add-on, track member whose upper surface is substantially of the same operative length and support shape as provided by an associated track on an upright panel of the structural grid, for providing a similar surface support as provided on said grid and so as to provide, in the bay of the grid, spaced support tracks for the base end of the container and for the belly of the container, and said add-on track member providing, on the underside thereof, a plurality of snap-connector means constructed and arranged for cooperation with at least two of the said snap-onto male connector means provided on said elongated spacer shafts of the structural grid.

2. A construction as in claim 1 wherein the snap-connector means on the underside of the add-on track member include at least two spaced pairs of oppositely facing locking clips cantilevered from, and projecting below, the track member, with each clip of said clip pairs being of a transverse size, shape and dimension adapted to enter into a female-socket of one of the spacer shafts, the maximum transverse size of the portion of said cantilevered locking clip which is positioned to enter a female-socket being slightly less than the axial spacing between said two upright flanges on the spacer shaft;

and each of the two oppositely facing cantilevered locking clips of each pair being shaped, on the surfaces facing each other, so as to provide on each clip a distal cam means and an adjacent seating recess located closer to said support surface of the track member than the cam means, said shapes being adapted to cooperate with the shape of the snap-onto male connector means to provide a secure snap-on connection between the add-on track member and said spacer shafts immediately therebelow.

3. A construction as in claim 1 wherein each upright panel is shaped to provide, adjacent to and below each longitudinal track thereon, the complementary socket means that are adapted to receive thereinto the ends of spacer shafts associated with said longitudinal track, said socket means associated with the longitudinal track being provided by a forward set of two laterally adjacent socket means that are located close to and below a forward end of the adjacent track, and a rearward set of two laterally adjacent socket means located close to and below the rearward end of the adjacent track; and said elongated add-on track member being provided, on the underside thereof, with four pairs of snap-connector means positioned along the length of the add-on track member at positions and spacings corresponding to the four locations of the socket means provided below each longitudinal track on the upright panel.

4. A construction as in claim 1 wherein the width of the support surface of the add-on track member is about twice the width of the associated adjacent longitudinal track provided on the upright panel.

5. A construction as in claim 1 wherein the add-on track member is an elongated body provided at both ends with an upturned stop.

6. A construction as in claim 5 wherein the upturned stops at the ends of the add-on track member are of mirror image facing each other.

7. A construction as in claim 5 wherein the elongated add-on track member and snap-connector means thereon are of mirror image construction relative to the mid-length point of the track member.

* * * * *